US009743174B2

(12) United States Patent
Oclee-Brown et al.

(10) Patent No.: US 9,743,174 B2
(45) Date of Patent: Aug. 22, 2017

(54) ACOUSTIC PHASE PLUG

(71) Applicant: GP Acoustics (UK) Limited, Maidstone (GB)

(72) Inventors: Jack Anthony Oclee-Brown, Tonbridge (GB); Mark Alexander Dodd, Woodbridge (GB)

(73) Assignee: GP ACOUSTICS (UK) LIMITED, Maidstone (GB)

( * ) Notice: Subject to any disclaimer, the term of this patent is extended or adjusted under 35 U.S.C. 154(b) by 0 days.

(21) Appl. No.: 14/771,037

(22) PCT Filed: Feb. 19, 2014

(86) PCT No.: PCT/EP2014/053222
§ 371 (c)(1),
(2) Date: Aug. 27, 2015

(87) PCT Pub. No.: WO2014/131669
PCT Pub. Date: Sep. 4, 2014

(65) Prior Publication Data

US 2016/0014503 A1 Jan. 14, 2016

(30) Foreign Application Priority Data

Feb. 27, 2013 (GB) ..... 1303516.7

(51) Int. Cl.
*H04R 1/02* (2006.01)
*H04R 1/20* (2006.01)
(Continued)

(52) U.S. Cl.
CPC ..... *H04R 1/30* (2013.01); *H04R 1/22* (2013.01); *H04R 2201/34* (2013.01); *H04R 2400/13* (2013.01)

(58) Field of Classification Search
CPC ..... H04R 1/30; H04R 1/22; H04R 2201/34; H04R 2400/13
(Continued)

(56) References Cited

U.S. PATENT DOCUMENTS 5,117,462 A 5/1992 Bie
6,574,344 B1 * 6/2003 Wiener ..... H04R 1/345 181/152
(Continued)

FOREIGN PATENT DOCUMENTS

JP H05183986 A 7/1993
WO 2004040942 A1 5/2004

OTHER PUBLICATIONS

International Search Report and Written Opinion issued for International Application No. PCT/EP2014/053222, mailed May 8, 2014.
(Continued)

*Primary Examiner* — Duc Nguyen
*Assistant Examiner* — Sean H Nguyen
(74) *Attorney, Agent, or Firm* — Westman, Champlin & Koehler, P.A.; Z. Peter Sawicki; Amanda M. Prose

(57) ABSTRACT

A phase plug for a loudspeaker having a driven diaphragm, wherein at least a portion of the surface of the phase plug disposed in use adjacent the diaphragm is generally annular in two orthogonal directions and has an axis in a third orthogonal direction, and wherein at least a portion of the said annular surface is shaped such that as successive radial cross-sections through the annular surface are generated by rotating a plane about the axis, the cross-sectional shape of the surface of the phase plug varies periodically as the angle of rotation increases.

11 Claims, 3 Drawing Sheets

(51) Int. Cl.
*H04R 1/30* (2006.01)
*H04R 1/22* (2006.01)

(58) Field of Classification Search
USPC ..... 381/343; 77/343
See application file for complete search history.

(56) References Cited

U.S. PATENT DOCUMENTS

2001/0040974 A1 11/2001 Steckling
2002/0057819 A1* 5/2002 Czerwinski ..... H04R 1/30
381/398
2005/0025331 A1* 2/2005 Button ..... H04R 7/127
381/403

OTHER PUBLICATIONS

Search Report issued for GB Patent Application No. 1303516.7, mailed May 9, 2013.

* cited by examiner

ACOUSTIC PHASE PLUG

CROSS-REFERENCE TO RELATED APPLICATION

This Application is a Section 371 National Stage Application of International Application No. PCT/EP2014/053222 filed Feb. 19, 2014 and published as WO/2014/131669 A1 on Sep. 4, 2014, in English, which claims priority to and benefit of GB Patent Application No. 1303516.7, filed Feb 27, 2013, the contents of which are hereby incorporated by reference in their entirety.

FIELD OF THE INVENTION

The present invention relates to an acoustic phase plug used in systems for converting electrical signals into sound, such as a phase plug for a compression driver or loudspeaker.

BACKGROUND ART

Phase plugs are usually disposed, in use, adjacent a diaphragm, the diaphragm being driven axially to generated sound waves; these sound waves are channelled by the phase plug so as to enhance the acoustic performance of the diaphragm. Conventional phase-plugs have an axisymmetric surface which closely follows the geometry of the associated diaphragm. The enclosed volume of air between the diaphragm and phase-plug must be sufficiently small to avoid loss of high frequency output due to acoustic compliance. To achieve maximum low frequency output the diaphragm must move with the largest possible displacement.

Some attempts have been made to shape the diaphragm in the axial direction so as to increase its stiffness, and thus improve its acoustic performance; however, the introduction of such shapes inevitably either reduces the clearance between the phase plug and the diaphragm (which is undesirable, as it risks the diaphragm impinging on the phase plug during operation, which has a drastic adverse effect on the sound quality), or it increases the volume of the cavity between the diaphragm and phase-plug, which is also undesirable. As a result of this, and other practical constraints, the size of the axial shaping is severely restricted in the part of the phase plug facing the diaphragm.

SUMMARY OF THE INVENTION

Accordingly the present invention provides a phase plug for a loudspeaker having a driven diaphragm, wherein at least a portion of the surface of the phase plug disposed in use adjacent the diaphragm is generally annular in two orthogonal directions and has an axis in a third orthogonal direction, and wherein at least a portion of the said annular surface is shaped such that as successive radial cross-sections through the annular surface are generated by rotating a plane about the axis, the cross-sectional shape of the surface of the phase plug intersecting said plane varies as the angle of rotation increases. The variation of the cross-section may be periodic.

Such an arrangement facilitates the shaping of a diaphragm in the axial direction to a significant extent, allowing the stiffness of the diaphragm to be optimised whilst avoiding the problems of diaphragm/phase plug impingement and unnecessarily and undesirably increasing the volume between the diaphragm and phase-plug.

The surface of the phase plug may further comprise one or more axisymmetric areas surrounding the periodically varying shaped portion. The generally annular surface may further comprise an axisymmetric portion inside the annular portion, and/or the surface of the phase plug may comprise a concave portion within the generally annular portion. This concave portion, which may be centred on the axis (and substantially axisymmetric), may be generally dome-shaped—a concave dome shaped as part of a sphere, ellipsoid, paraboloid or hyperboloid, for example.

The phase plug may include at least one channel for sound waves generated by a diaphragm disposed adjacent the phase plug to pass through, the or each channel terminating adjacent the periodically varying shaped portion of the phase plug surface.

The non-axisymmetric portion may extend circumferentially around a concave surface, which may be axisymmetric. The varying shaped portion may extend smoothly and/or substantially uninterruptedly around the axisymmetric surface. Portions of the surface of the phase plug other than the periodically varying shaped portion(s) may be axisymmetric; apart from the optional central portion of the surface of the phase plug, there may be a substantially flat or planar surface forming an annulus inside and/or outside the varying shaped portion.

The periodically varying shaped portions of the phase plug surface may comprise a series of axial cavities formed in the generally annular surface: this series of cavities may be formed as separate, but substantially similar individual cavities disposed generally circumferentially around the generally annular surface (these cavities may be evenly distributed about the circumference), or it may comprise a single, sinuously shaped cavity. The periodically varying shaped portion may extend substantially uninterruptedly around the annular surface, and/or it may be smooth and blend smoothly with the surrounding portions of the surface, or it may comprise a series of cavities which are themselves smooth but which are discontinuous where they blend into the generally annular surface of the phase plug. Alternatively or additionally the periodically varying shaped portion(s) may be in the form of a succession of undulations, or of substantially continuous curves, which may have a sinusoidal appearance. The undulations may protrude from the general plane of the annular surface in either or both directions in the axial direction.

The present invention recognises that improved acoustic performance may be achieved by using a geometry for the phase-plug surface which is not wholly axisymmetric but instead is of varying radial cross-sectional shape in an annular region so as to provide a concave and variably shaped region to allow for the termination of a channel for soundwaves generated by the diaphragm thereat. This region may be formed as a series of smoothly-shaped regular cavities in the surface (e.g. circles/domes, triangles, or essentially any rectilinear or curved shape), or as a succession of circumferential undulations in the generally annular portion of the surface of the phase plug. The maximum output for a given cavity volume may be obtained by making the phase-plug surface the same shape as the displaced diaphragm surface. This approach allows much greater freedom in the choice of circumferential undulations and their size. For example the circumferential undulations may even be greater than the phase-plug to diaphragm spacing.

The phase plug will, as is conventional, have one or more channels for soundwaves generated by the diaphragm. These channels may be radial or annular or a series of circular holes or other shape. At least one of these channels may terminate at or adjacent the periodically varying shaped portion of the phase plug surface.

In another aspect, the present invention also encompasses a loudspeaker incorporating a phase plug as described herein.

For convenience, the present invention is principally described herein with reference to a circular phase plug, however the invention applies equally to non-circular phase plugs, such as elliptical or race track shapes, or any shape being symmetrical in two orthogonal directions and lying in the general plane of the phase plug surface which in use is intended to lie adjacent an acoustically-driven diaphragm. Accordingly, or unless clearly indicated otherwise, any use in this description or in the claims of the terms "annular", "circumference", "circumferential", "circumferentially", "concentric" or "around" should not be construed as being restricted to a circular shape alone, nor as being necessarily centred on a single axis but instead as simply surrounding a boundary. Similarly, the term "appears sinusoidal" should not be construed as limited to a strictly sinusoidal shape, but instead construed broadly as encompassing any substantially smooth series of substantially continuous and substantially cyclical curves.

BRIEF DESCRIPTION OF THE DRAWINGS

An embodiment of the present invention will now be described by way of example, with reference to the accompanying figures in which.

DETAILED DESCRIPTION OF THE EMBODIMENTS

Figure 1:
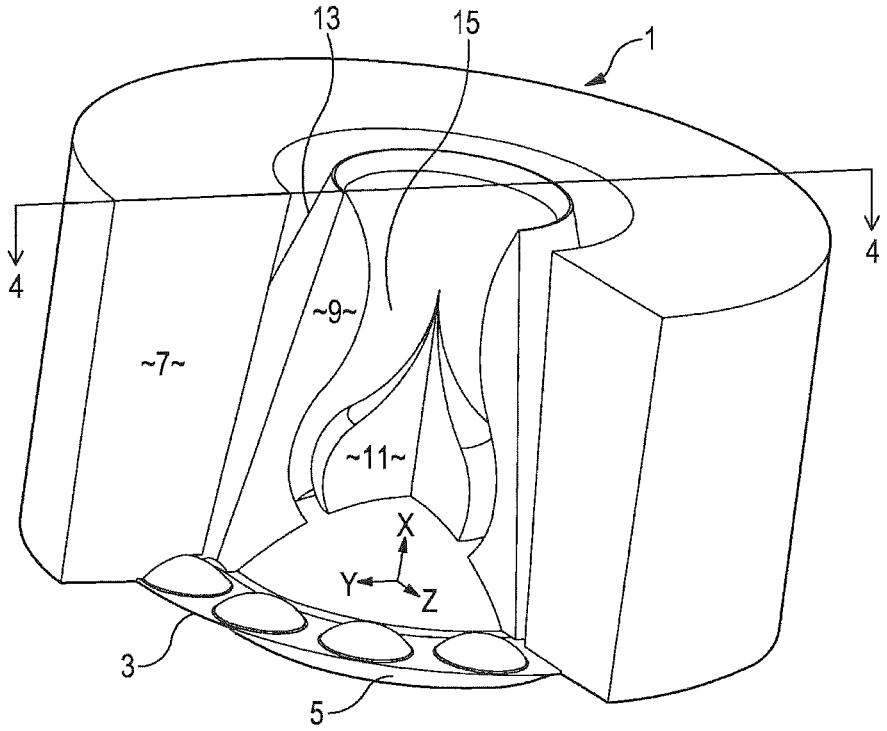
FIG. 1 is a schematic view, in perspective, of part of a phase plug in accordance with the invention disposed for use with a diaphragm.
Figure 4:
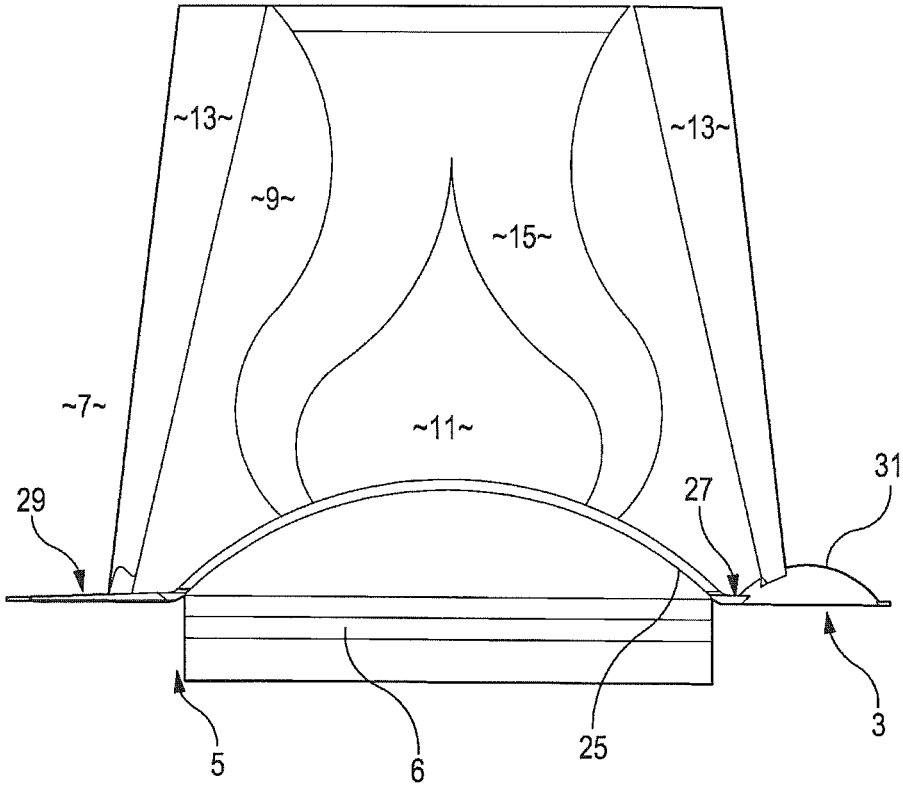
FIG. 4 is a partial cross-sectional view of the plane indicated by the arrows 4-4 in FIG. 1.

The phase plug 1 shown in FIG. 1 is illustrated as it would be in use in a compression driver, or loudspeaker, disposed adjacent to a diaphragm 3 which is driven by a voice coil 5 (the voice coil 5 is connected to the diaphragm 3 by a bobbin 6, see FIG. 4). The phase plug 1 comprises three pieces 7, 9, 11 which are connected as is known in the art and disposed so as to provide two concentric annular channels 13, 15 for the soundwaves generated by the diaphragm 3; the length and shape of these channels are important factors in ensuring that the compression driver is efficient and a high quality of sound reproduction, however the channels do not form part of the present invention per se, nor does the precise composition of the phase plug, or its shape and configuration other than adjacent the diaphragm and in relation to one soundwave channel as will become apparent.

Figure 2:
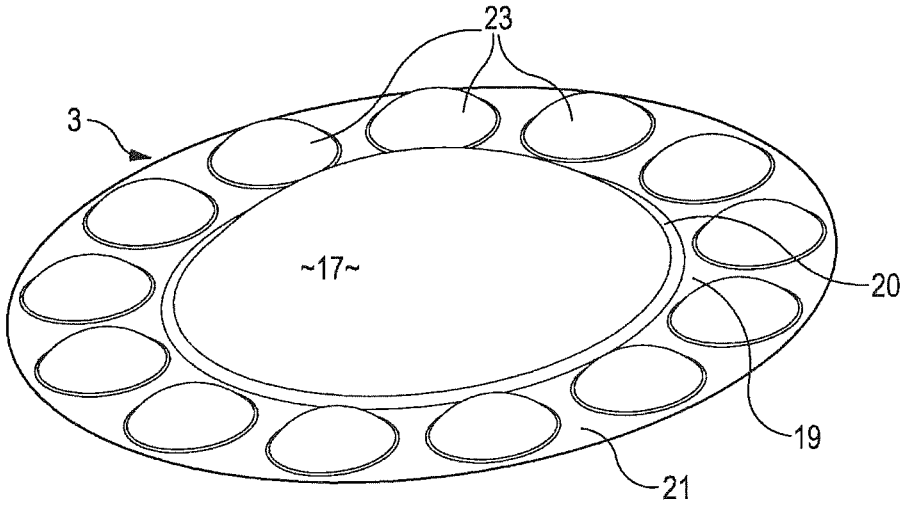
FIG. 2 is a perspective view of the diaphragm of FIG. 1.

As can be seen in FIG. 2, the diaphragm 3 has a dome-shaped central portion 17, which extends to a planar region 19, to the reverse of which the voice coil 5 is attached and is arranged to vibrate the diaphragm 3 parallel to the X axis (FIG. 1 shows the orthogonal X, Y and Z axes). Between the central domed portion 17 and the planar region 19 is a blend radius 20. Surrounding the planar region 19 is a generally flat, annular portion 21, disposed circumferentially around which is a plurality of dome-shaped protrusions 23, so that the annular portion 21 of the diaphragm is non-axisymmetric about the X axis, in that as successive radial cross-sections through the annular surface are generated by rotating a plane about the X axis, the cross-sectional shape of the surface of the phase plug varies periodically as the angle of rotation increases. FIG. 2 shows a diaphragm having in total 13 protrusions 23 distributed evenly about the plane of the generally annular portion 21, and the complementary phase plug would have a corresponding number and distribution of cavities.

The surface of the phase plug 1 is configured and disposed relative to the diaphragm 3 so as to provide an air cavity 25 (see FIG. 4) therebetween, the dimensions of which are most important: for maintaining loudspeaker efficiency at high frequencies, the volume of the air cavity 25 must be small, but the distance between the diaphragm 3 and the adjacent face of the phase plug 1 (i.e. in the X direction in the drawings) must be sufficiently large so that no part of the diaphragm impinges on the phase plug when the diaphragm is being driven. Accordingly, the surface of the phase plug 1 intended to be adjacent the diaphragm 3 in use is concavely dome-shaped in its centre, with a narrow planar annular region 27 to match region 19 of the diaphragm/drive coil, and then has a generally planar, annular portion 29 in which there are concave depressions, or cavities 31 (more easily seen in FIG. 3) to accommodate the protrusions 23. The cavities are evenly distributed about the annulus 29. As can be seen in FIGS. 1 and 4, one of the sound channels (the innermost channel 15) terminates at the dome-shaped part of the phase plug/diaphragm, while the other, outermost channel 13 terminates at the annular portion 29. The termination of the channel 13 at portion 29 (see FIG. 4) occurs at a point coincident with the dome-shaped cavities 31. Accordingly, whereas the termination of the inner channel 15 forms an axisymmetric annulus around the circumference of the dome, the termination of the outer channel 13 adjacent the diaphragm is non-axisymmetric, and forms a series of undulations which can be inferred from FIG. 4. Preferably these undulations are relatively smooth, apart from the intersections of the protrusions 23 with the annular portion 21, which are quite sharp (and as shown in the drawings, FIG. 3 in particular). Alternatively, these intersections may be relatively smoothly radiussed.

Figure 3:
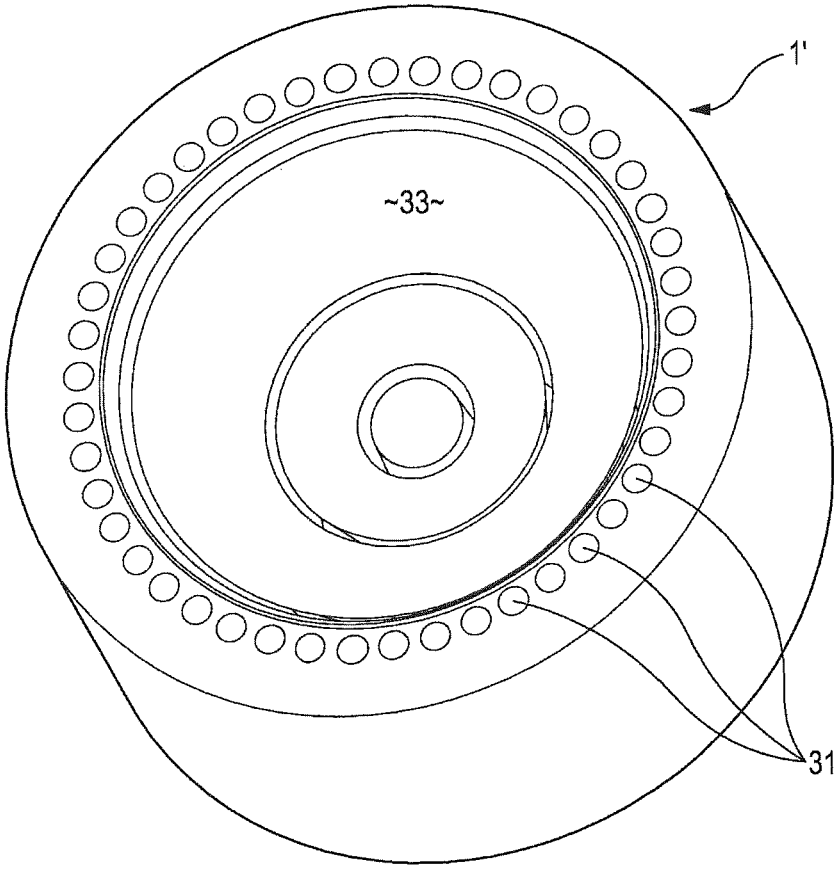
FIG. 3 is a perspective view of the concave surface of a phase plug similar to that of FIG. 1.

Referring to FIG. 3, this illustrates an alternative phase plug 1' which has a central dome-shaped concave depression 33 with three separate channels for soundwaves generated by the dome-shaped part of the diaphragm (not shown). A channel terminating along the line of the circumferential cavities 31 is not shown in FIG. 3, so that the cavities 31 can be more clearly appreciated. It will also be understood that the number and disposition of cavities and channels can vary, and that the number, shape and configuration of channels can vary; what is significant for the purpose of this invention is that the phase plug adjacent the diaphragm has an essentially annular portion 21 (but which should not necessarily be planar, or indeed have any part at all which is planar) which is shaped so as to vary in cross-section as already described, in order to provide a non-axisymmetric surface for at least one soundwave channel to terminate on. We have found that such a shape of phase plug surface is conducive both to high frequency efficiency and sound quality across a wide bandwidth; also adjusting the size and/or number of undulations at the termination of the channel in the phase plug allows "tuning", a process well-known in the art, so as for example to minimise modal excitation and/or interference, whilst maintaining or improving efficiency.

Typically the phase-plug to diaphragm spacing may be in the region of 0.1 mm-1.2 mm and the ratio of the effective diaphragm radiating area to phase-plug entrance area, also called compression ratio, is between 5 and 12. The mean flux at the voice coil is limited by the saturation of the iron poles and is between 1.2 Tesla and 2.1 Tesla depending on the magnet size and cost. The majority of compression drivers use a titanium diaphragm and an aluminium voice coil, which is often copper clad to improve electrical connectivity.

FIG. 3 shows a phase plug having in total 45 cavities distributed evenly about the plane of the generally annular portion 29; it will be appreciated that each cavity therefore subtends 8 degrees of the total circle of rotation.

It will of course be understood that many variations may be made to the above-described embodiment without departing from the scope of the present invention. For example, although the drawings illustrate a series of dome-shaped cavities 31, these may be of any smoothly concave shape (e.g. elliptical, ovoid, rectangular, lozenge, etc.), or even be formed of a continuously curved surface having radial and/or circumferential undulations, which may appear sinusoidal and which may be periodically or cyclically curved. There may be any number of cavities, and these may be arranged in one or more circumferential rows, which can be aligned, staggered or arranged symmetrically, according to the relevant acoustic desiderata. Similarly, although the phase plug in the drawings has a generally dome-shaped or spherical central cavity, this may be of any smoothly curved shape, such as an ellipsoid, hyperboloid or paraboloid or a surface derived from a part of the surface of a toroid, and although shown as axi-symmetric the shape of this cavity may be non-axisymmetric. The cavities are shown evenly spaced around a circle, however for some applications the cavities could be unevenly spaced, and/or the cycle of any curves could vary. Furthermore, where different variations or alternative arrangements are described above, it should be understood that embodiments of the invention may incorporate such variations and/or alternatives in any suitable combination.

The invention claimed is:

1. A phase plug for a loudspeaker having a driven diaphragm, wherein at least a portion of the surface of the phase plug which in use is disposed adjacent to the diaphragm is generally planar, annular in two orthogonal directions and has an axis (X) in a third orthogonal direction which is parallel to the axis along which the diaphragm is, in use, driven, wherein at least a portion of the said annular surface is shaped such that as successive radial cross-sections through the annular surface are generated by rotating a plane about the axis, the cross-sectional shape of the surface of the phase plug varies periodically as the angle of rotation increases, and wherein the centre of the surface of the phase plug which in use is disposed adjacent to the diaphragm is concave.

2. A phase plug according to claim 1, wherein the surface of the phase plug further comprises axisymmetric areas surrounding the periodically varying shaped portion.

3. A phase plug according to claim 1, wherein the said generally annular surface further comprises an axisymmetric portion inside the annular portion.

4. A phase plug according to claim 1 wherein the phase plug has at least one channel for the passage of sound waves generated by a diaphragm disposed adjacent the phase plug, which channel terminates adjacent the periodically varying shaped portion of the phase plug surface.

5. A phase plug according to claim 1 wherein the periodically varying shaped portions comprise concave depressions formed in the annular surface portion of the phase plug.

6. A phase plug according to any of claim 1, wherein the periodically varying shaped portion extends smoothly and/or substantially uninterruptedly around the annular surface.

7. A phase plug according to claim 6, wherein the periodically varying shaped portion comprises undulations formed in the annular surface portion of the phase plug.

8. A phase plug according to claim 7 wherein the undulations form a succession of substantially continuous curves when viewed along the axis.

9. A phase plug according to claim 8 wherein the curves appear circumferentially sinusoidal.

10. A phase plug according to claim 7 wherein the undulations protrude from the generally annular surface of the phase plug in either or both directions along the said axis.

11. A loudspeaker comprising a phase plug according to claim 1.

* * * * *